US008778239B2

(12) United States Patent
Mulwa et al.

(10) Patent No.: US 8,778,239 B2
(45) Date of Patent: Jul. 15, 2014

(54) PARTICULATE PRODUCTION METHOD

(75) Inventors: Andrew Mwaniki Mulwa, Kanagawa (JP); Yoshihiro Norikane, Kanagawa (JP); Shinji Aoki, Kanagawa (JP); Masaru Ohgaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 13/588,283

(22) Filed: Aug. 17, 2012

(65) Prior Publication Data

US 2013/0069262 A1 Mar. 21, 2013

(30) Foreign Application Priority Data

Sep. 20, 2011 (JP) ..... 2011-204401
Jun. 25, 2012 (JP) ..... 2012-142199

(51) Int. Cl.
*G03G 9/08* (2006.01)

(52) U.S. Cl.
USPC ..... 264/5; 264/9; 430/137.1

(58) Field of Classification Search
None
See application file for complete search history.

(56) References Cited

U.S. PATENT DOCUMENTS

| | | | | |
|---|---|---|---|---|
| 8,257,898 | B2 | 9/2012 | Norikane et al. | |
| 2004/0048183 | A1* | 3/2004 | Teshima | 430/137.1 |
| 2006/0210909 | A1 | 9/2006 | Ohtani | |
| 2008/0063971 | A1 | 3/2008 | Watanabe et al. | |
| 2008/0286680 | A1 | 11/2008 | Norikane et al. | |
| 2009/0107196 | A1* | 4/2009 | Jung | 71/59 |
| 2009/0117486 | A1 | 5/2009 | Watanabe et al. | |
| 2009/0170018 | A1 | 7/2009 | Kuramoto et al. | |
| 2009/0239170 | A1 | 9/2009 | Honda et al. | |
| 2009/0325100 | A1 | 12/2009 | Watanabe et al. | |
| 2010/0003613 | A1 | 1/2010 | Honda et al. | |
| 2010/0021209 | A1 | 1/2010 | Watanabe et al. | |
| 2010/0227267 | A1 | 9/2010 | Shitara et al. | |
| 2011/0007116 | A1 | 1/2011 | Ohgaki | |
| 2011/0014565 | A1 | 1/2011 | Norikane et al. | |
| 2011/0305987 | A1 | 12/2011 | Yohichiroh et al. | |
| 2012/0070777 | A1 | 3/2012 | Makabe et al. | |
| 2012/0094231 | A1 | 4/2012 | Norikane et al. | |

FOREIGN PATENT DOCUMENTS

| | | |
|---|---|---|
| JP | 57-201248 | 12/1982 |
| JP | 2003-262976 | 9/2003 |
| JP | 2003-262977 | 9/2003 |
| JP | 2006-293320 | 10/2006 |
| JP | 2011-059567 | 3/2011 |

OTHER PUBLICATIONS

U.S. Appl. No. 13/557,601, filed Jul. 25, 2012, Norikane, et al.

* cited by examiner

*Primary Examiner* — Mary F Theisen
(74) *Attorney, Agent, or Firm* — Oblon, Spivak, McClelland, Maier & Neustadt, L.L.P.

(57) ABSTRACT

A method of producing particulate, including introducing an initial liquid including a particulate component in a lower concentration than that of a liquid including a particulate component or no concentration to a projection hole of a droplet projector so as to be projected at the start of the discharging; discharging a droplet of the liquid comprising a particulate component from the projection hole; and solidifying the droplet to form a particulate.

7 Claims, 8 Drawing Sheets

START
DISCHARGING

60 MINUTES LATER

PARTICULATE PRODUCTION METHOD

CROSS-REFERENCE TO RELATED APPLICATIONS

This patent application is based on and claims priority pursuant to 35 U.S.C. §119 to Japanese Patent Applications Nos. 2011-204401 and 2012-142199, filed on Sep. 20, 2011 and Jun. 25, 2012, respectively, in the Japanese Patent Office, the entire disclosure of which is hereby incorporated herein by reference.

FIELD OF THE INVENTION

The present invention relates to a method of producing particulate such as a toner for developing an electrostatic latent image in electrophotography, electrostatic recording, electrostatic printing, etc.

BACKGROUND OF THE INVENTION

Methods of preparing a toner for developing electrostatic latent image, used in image forming apparatuses such as electrophotographic copiers, printers, facsimile and their complex machines have been mostly pulverization methods, but polymerization methods have been more used recently. The polymerization method is so called because of forming a particulate toner in an aqueous medium and including a polymerization reaction of toner materials when forming the particulate toner or in the process thereof. The polymerization methods include suspension polymerization methods, emulsification aggregation methods, polymer suspension (aggregation) methods and ester elongation methods. Atoner prepared by the polymerization methods is called a polymerization toner or a chemical toner.

The polymerization toner typically has smaller particle diameter, a narrower particle diameter distribution and more spherical shape than the pulverization toner. This is why the polymerization toner produces higher quality images in electrophotography. However, the polymerization toner needs a long time in the polymerization process, further needs separating a toner from a solvent after solidified, and then repeating washing and drying, resulting in disadvantages of needing much timer, water and energy.

Japanese Patents Nos. 3786034 and 3786035 (relevant to Japanese published unexamined applications Nos. 2003-262976 and 2003-262977, respectively) and Japanese published unexamined applications Nos. 57-201248 and 2006-293320 disclose toner preparation methods called spray granulation methods discharging a liquid (toner component liquid) including toner materials dissolved or dispersed in an organic solvent with an atomizer so as to become a microscopic droplet and drying the droplet to prepare a particulate toner. This method does not need using water and largely reduces time for washing and drying.

When a particulate such as a toner is produced by the spray granulation methods, it is preferable to project a droplet of a liquid including a particulate component such as a toner component liquid from a projection hole of a droplet projector and solidify the droplet. Conventional inkjet recording technology can be used to precisely control the size of the droplet projected from the projection hole of the droplet projector, and therefore the particle diameter of the particulate can precisely be controlled.

However, the droplet is not properly projected from the projection hole occasionally when starting discharging. This is because the liquid including a particulate component covering an exit of the projection hole is dried until starting discharging to increase viscosity or the liquid including a particulate component is dried and solidified to block the projection hole. The projection hole incapable of properly discharging a droplet when starting discharging is not restored even if driven to continue discharging. Therefore, such a projection hole incapable of properly discharging a droplet decreases productivity of the particulate.

Even if the droplet is properly projected from the projection hole at the beginning, the liquid including a particulate component covering an exit of the projection hole is dried to increase viscosity or partially solidified to block the projection hole while projected, the droplet is likely not to be properly projected, resulting in decrease of productivity of the particulate.

In order to continue properly discharging a droplet, a method of stopping the projection hole from discharging and washing the hole to restore projectability of the hole incapable of properly discharging the droplet can be thought. However, the productivity of the particulate decreases because of not being produced while the projection hole is washed.

Because of these reasons, a need exist for a method capable of improving productivity of particulate when discharging a droplet of a liquid including a particulate component from a projection hole of a droplet projector to produce a particulate.

SUMMARY OF THE INVENTION

Accordingly, one object of the present invention to provide a method capable of improving productivity of particulate when discharging a droplet of a liquid including a particulate component from a projection hole of a droplet projector to produce a particulate.

This object of the present invention, either individually or collectively, has been satisfied by the discovery of a method of producing particulate, comprising:

introducing an initial liquid comprising a particulate component in a lower concentration than that of a liquid comprising a particulate component or no concentration to a projection hole of a droplet projector so as to be projected at the start of the discharging;

discharging a droplet of the liquid comprising a particulate component from the projection hole; and solidifying the droplet to form a particulate.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
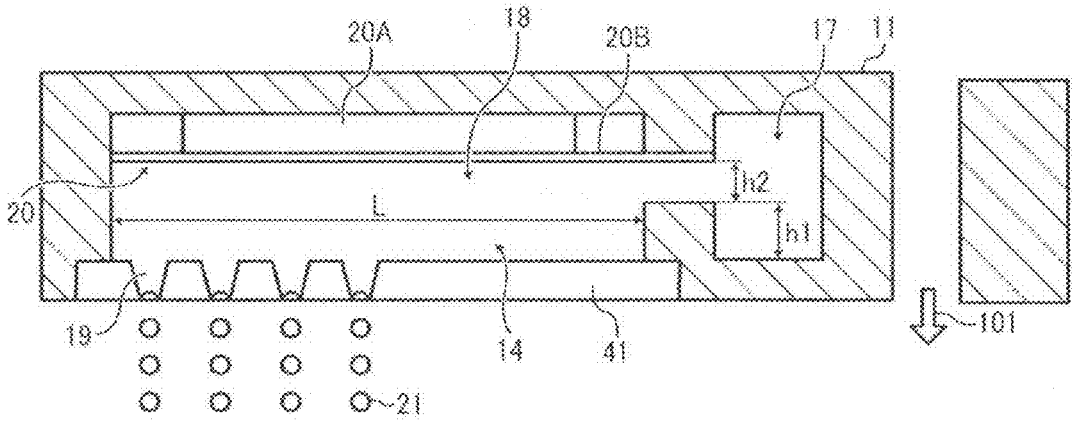
FIG. 1 is a schematic amplified view illustrating a part of a droplet projection part of a liquid-column resonant droplet projector for use in the present invention.

The present invention provides a method capable of improving productivity of particulate when discharging a droplet of a liquid including a particulate component from a projection hole of a droplet projector to produce a particulate.

More particularly, the present invention relates to a method of producing particulate, comprising:

introducing an initial liquid comprising a particulate component in a lower concentration than that of a liquid comprising a particulate component or no concentration to a projection hole of a droplet projector so as to be projected at the start of the discharging;

discharging a droplet of the liquid comprising a particulate component from the projection hole; and solidifying the droplet to form a particulate.

Hereinafter, an embodiment of the particulate production method of the present invention, applied to toner preparation is explained, referring to the drawings.

A toner preparation method of this embodiment continues discharging a droplet of a toner component liquid (liquid including a particulate component), the droplet of which becomes a toner (particulate) when solidified from a projection hole of a droplet projector while replenishing the droplet projector with the liquid, and solidifies the projected droplet to form a toner.

The droplet projector preferably projects a droplet having a narrow particle diameter distribution, but is not particularly limited and known droplet projectors can be used. Specific examples of the droplet projector include one-fluid nozzles, two-fluid nozzles, film oscillation projection means, Rayleigh split projection means, liquid oscillation projection means, liquid-column resonant projection means, etc. Japanese published unexamined application No. 2008-292976 discloses an embodiment of the film oscillation projection means, Japanese Patent No, 4647506 discloses an embodiment of the Rayleigh split projection means, and Japanese published unexamined application No. 2010-102195 discloses an embodiment of the liquid oscillation projection means.

In order to ensure narrow article diameter distribution and productivity of a toner, a liquid-column resonant droplet projector oscillating a liquid in its liquid-column resonant chamber plural projection holes are formed on to form a liquid-column resonant standing wave and discharging the liquid from the projection holes formed in an area which is an abdominal of the standing wave is preferably used. Preparation of toner using the liquid-column resonant droplet projector is explained.

FIG. 1 is a schematic amplified view illustrating a part of a droplet projection part 11 of a liquid-column resonant droplet projector for use in the present invention.

Figure 2:
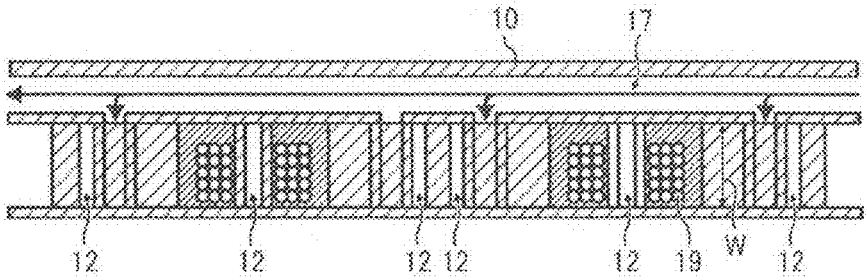
FIG. 2 is a schematic cross-sectional view illustrating a part of a liquid-column resonant droplet forming unit as the liquid-column resonant droplet projector.

The droplet projection part 11 includes a liquid-column resonant liquid chamber 18, which is communicated with a liquid common feed pathway 17 through a communication pathway located on one of walls (opening side walls) at both ends in a longitudinal direction (horizontal direction in FIG. 1). The liquid-column resonant liquid chamber 18 includes plural projection holes 19 discharging a droplet 21 on one of walls (bottom wall below in FIG. 1) communicating between side walls at both ends in a longitudinal direction. An oscillator 20 generating a high-frequency oscillation to form a liquid-column resonant standing wave is located on the upper wall opposite to the toner projection hole 19 in the liquid-column resonant liquid chamber 18. The oscillator 20 is connected with an unillustrated high-frequency electric source, FIG. 2 is a schematic cross-sectional view illustrating a part of a liquid-column resonant droplet forming unit 10 as the liquid-column resonant droplet projector. FIG. 2 is a view seen from above or below.

A liquid projected from the droplet projection part 11 is a liquid including a particulate component, in which the particulate component is dissolved or dispersed. Hereinafter, the liquid including a particulate component is referred to as a toner component liquid. The toner component liquid is flown in the liquid common feed pathway 17 of the liquid-column resonant droplet forming unit 10 and filled in the liquid-column resonant liquid chamber 18 of the droplet projection part 11.

A pressure distribution is formed by the liquid-column resonant standing wave generated by the oscillator 20 in the toner component liquid 14 filled in the liquid-column resonant liquid chamber 18. The droplet 21 is projected from the projection hole 19 located at an abdominal area of the standing wave having large amplitude and pressure variation. The abdominal area of the standing wave by the liquid-column resonance is an area besides a node of the standing wave. Preferably an area where the pressure variation of the standing wave has an amplitude large enough to project the liquid, and more preferably in a range within ±¼ wavelength from a position where the pressure standing wave has a maximum amplitude (a node as a velocity standing wave) to a position where the pressure standing wave has a minimum amplitude. Even plural projection holes respectively form uniform droplets when they are in the abdominal area of the standing wave. When the toner component liquid in the liquid-column resonant liquid chamber 18 decreases, a suction power of the liquid-column resonant standing wave therein increases the toner component liquid fed from the liquid common feed pathway 17 and the liquid is filled in the liquid-column resonant liquid chamber 18.

The liquid-column resonant liquid chamber 18 of the droplet projection part 11 is formed of joined frames made of materials high rigidity so as not to influence the resonant frequency of a liquid, such as metals, ceramics and silicon. As FIG. 1 shows, a length L between the walls at both ends of the liquid-column resonant liquid chamber 18 in a longitudinal direction is determined, based on a liquid-column resonance principle mentioned later. As FIG. 2 shows, a width between side walls at both ends of the liquid-column resonant liquid chamber 18 in a crosswise direction is preferably less than a half of the length L thereof so as not to impart an unnecessary frequency to the liquid-column resonance.

Further, plural liquid-column resonant liquid chamber s 18 are preferably located in one liquid-column resonant droplet forming unit 10 to improve productivity. The number of the liquid-column resonant liquid chamber 18 is not limited, and the liquid-column resonant droplet forming unit 10 preferably includes 100 to 2,000 liquid-column resonant liquid chambers 18 to have both operability and productivity. Plural liquid-column resonant liquid chambers 18 are communicated with a liquid common feed pathway 17.

The oscillator 20 in the droplet projection part 11 is not particularly limited if driven by a predetermined frequency and a piezoelectric body 20A is preferably laminated on an elastic plate 20B. The elastic plate 20B separates the piezoelectric body 20A from the liquid-column resonant liquid chamber 18 such that the piezoelectric body 20A does not contact the liquid. A piezoelectric ceramic such as lead zirconate titanate (PZT) can be used as the piezoelectric body 20A, and is typically layered because of having a small displacement. Besides, piezoelectric polymers such as polyvinylidenefluoride, and single crystals such as crystals, $LiNbO_3$, $LiTaO_3$ and $KNbO_3$ can also be used. The oscillator 20 is preferably located in each of the liquid-column resonant liquid chambers 18 so as to individually be controlled. A piezoelectric body material is preferably cut to plural piezoelectric bodies according to the location of the liquid-column resonant liquid chamber 18 so as to individually control each of them through the elastic plate.

The projection hole 19 preferably has an opening having a diameter of from 1 to 40 μm. When less than 1 μm, the droplet is too small to prepare a toner, and the projection hole 19 is frequently clogged when toner materials includes solid particulate materials such as pigments, resulting in deterioration of productivity. When larger than 40 μm, the toner composition needs to be diluted in a very thin organic solvent when dried and solidified to prepare a toner having a desired particle diameter of from 3 to 6 μm, and a large amount of drying energy is needed to prepare a specific amount of the toner.

As shown in FIG. 2, plural lines of plural projection holes 19 are preferably formed in a width direction (horizontal direction in FIG. 2) of the liquid-column resonant liquid chamber 18 to increase production efficiency because many droplets can be projected at one projection operation. The liquid-column resonant frequency is preferably determined after seeing projection of the droplet because of varying according to a location of the projection hole 19.

FIGS. 3A to 3D are various exemplified cross-sectional views of the projection holes 19 of the liquid-column resonant droplet forming unit.

The projection hole 19 has a tapered cross-sectional shape so as to have a smaller diameter at the opening in FIG. 1, and can have any shapes.

Figure 3A:
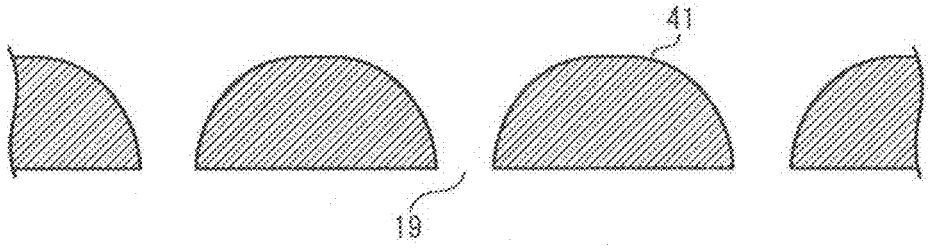
FIGS. 3A to 3D are various exemplified cross-sectional views of the projection holes of the liquid-column resonant droplet forming unit.

FIG. 3A has a shape so as to have a narrower opening while having a round form from a liquid contact surface to a projection exit of the projection hole 19. When a thin film 41 oscillates, a pressure to the liquid is maximum at the exit of the projection hole 19 and the shape is most preferable in stable discharging.

Figure 3B:
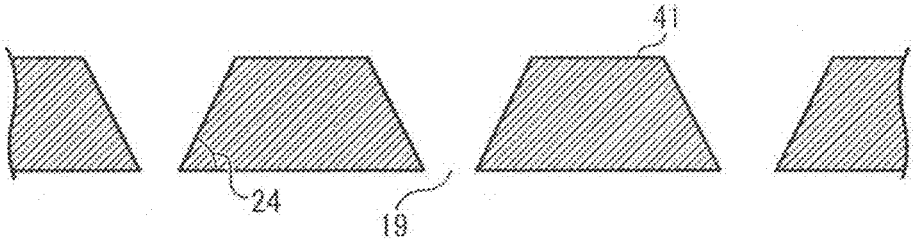
Figure 3C:
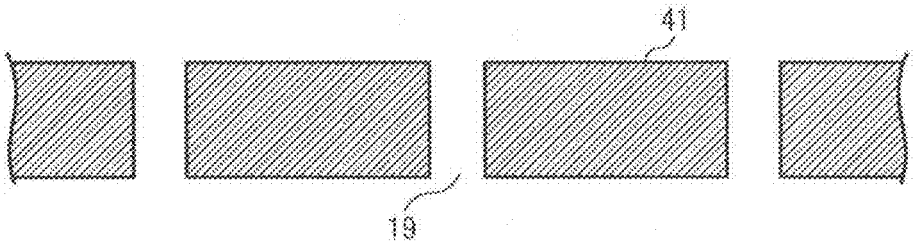

FIG. 3B has a shape so as to have a narrower opening at a specific changeable angle from a liquid contact surface to a projection exit of the projection hole 19. When a thin film 41 oscillates at the same angle of the nozzle in FIG. 4A, a pressure to the liquid can be increased the exit of the projection hole 19, and the angle is preferably from 60 to 90°. When less than 60°, it is difficult to apply a pressure to the liquid and the thin film is difficult to modify. FIG. 3C is the nozzle having an angle of 90°, and it is difficult to apply a pressure to the exit and 90° is a maximum. When greater than 90°, no pressure is applied to the exit of the projection hole 19 and droplet does not stably project at all.

Figure 3D:
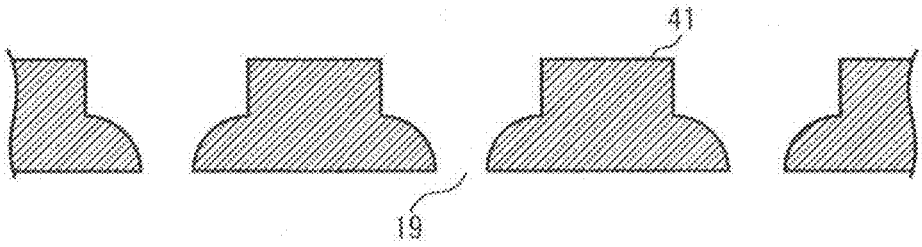

FIG. 3D is a combination of FIGS. 3A and 3C. The shape may be changed in stages in this way.

Next, the droplet forming mechanism by the liquid-column resonant droplet forming unit 10 is explained.

First, the principle of the liquid-column resonance phenomenon arising in the liquid-column resonant liquid chamber 18 in FIG. 1 is explained. The liquid resonance generates a wavelength λ has the following relationship:

$$\lambda = c/f \tag{1}$$

wherein c represents a sound velocity of the toner component liquid in the liquid-column resonant liquid chamber 18; and f represents a drive frequency applied from the oscillator 20 to the toner component liquid.

The (opening) side wall of the liquid-column resonant liquid chamber 18 on which a communication pathway is formed for communicating with the liquid common feed pathway 17 can be thought equivalent to opposite (closing) side wall a communication pathway is not formed on. When the liquid-column resonant liquid chamber 18 has a length L in a longitudinal direction equivalent to an even multiple of ¼ of the wavelength λ, a resonant oscillation is most efficiently generated by the oscillator 20 in a liquid in the liquid-column resonant liquid chamber 18. An optimal condition most efficiently generating a liquid-column resonance is represented by the following formula (2). This condition is the same even when both of the side walls of the liquid-column resonant liquid chamber 18 in a longitudinal direction are completely opened.

$$L = (N/4)\lambda \tag{2}$$

When one of the both side walls of the liquid-column resonant liquid chamber 18 in a longitudinal direction is opened and the other is closed, a resonant oscillation is most efficiently formed when the liquid-column resonant liquid chamber 18 has a length L in a longitudinal direction equivalent to an uneven multiple of ¼ of the wavelength λ. Namely, N in the formula (2) is an uneven multiple.

The most efficient drive frequency f is determined by the following formula (3) from the formulae (1) and (2). However, actually the liquid has viscosity attenuating the resonance, and the oscillation is not limitlessly amplified. As formulae (4) and (5) mentioned later show, even a frequency having a Q value, close to the most efficient drive frequency f having the formula (3) generates a resonance.

$$f = N \times c/(4L) \tag{3}$$

FIGS. 4A to 4D are explanatory views each for explaining a standing wave of a velocity distribution and a pressure distribution generated in a liquid in a liquid-column resonant chamber 18 of the liquid-column resonant droplet forming unit when N is 1, 2 and 3.

Figure 4A:
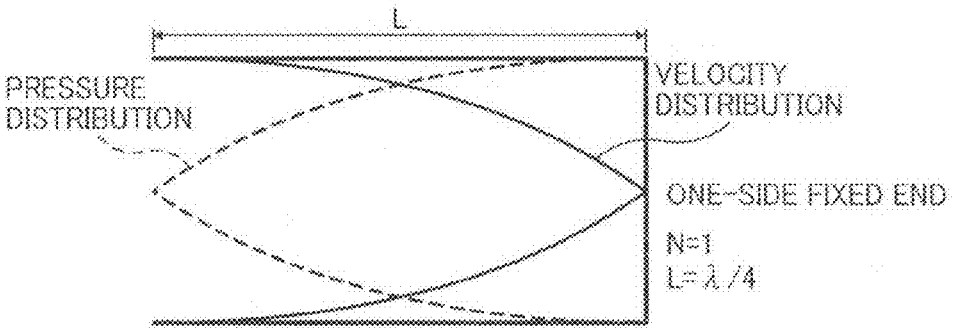
FIGS. 4A to 4D are explanatory views each for explaining a standing wave of a velocity distribution and a pressure distribution generated in a liquid in a liquid-column resonant chamber of the liquid-column resonant droplet forming unit when N is 1, 2 and 3.
Figure 4B:
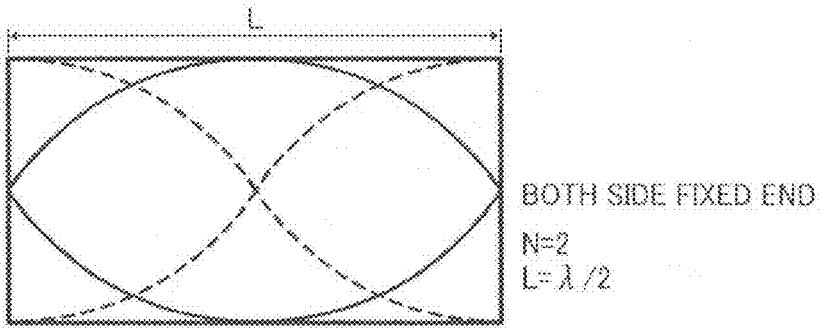
Figure 4C:
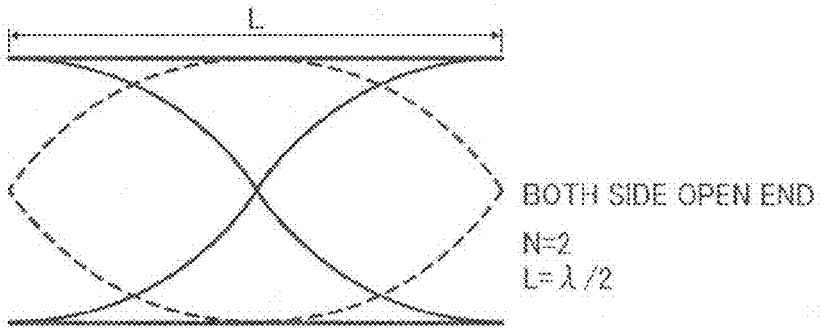
Figure 4D:
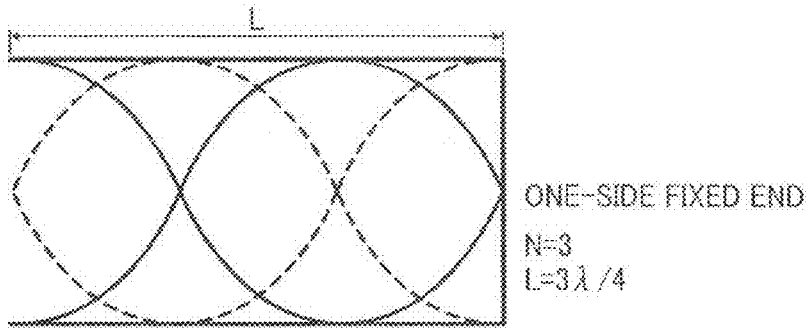

FIG. 4A shows one of both ends of the liquid-column resonant liquid chamber 18 in a longitudinal direction is opened and the other is closed when N=1. FIG. 4B shows both ends of the liquid-column resonant liquid chamber 18 in a longitudinal direction are closed when N=2. FIG. 4C shows both ends of the liquid-column resonant liquid chamber 18 in a longitudinal direction are opened when N=2. FIG. 4D shows one of both ends of the liquid-column resonant liquid chamber 18 in a longitudinal direction is opened and the other is closed when N=3.

Figure 5A:
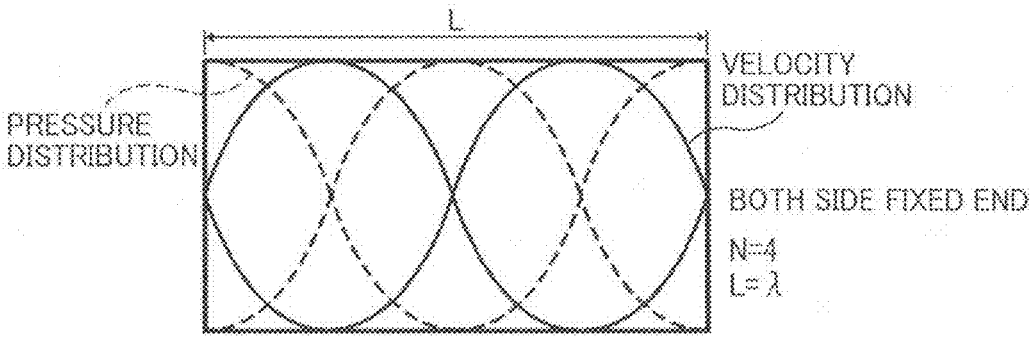
FIGS. 5A to 5C are explanatory views each for explaining a standing wave of a velocity distribution and a pressure distribution generated in the liquid in the liquid-column resonant chamber when N is 4 and 5.
Figure 5B:
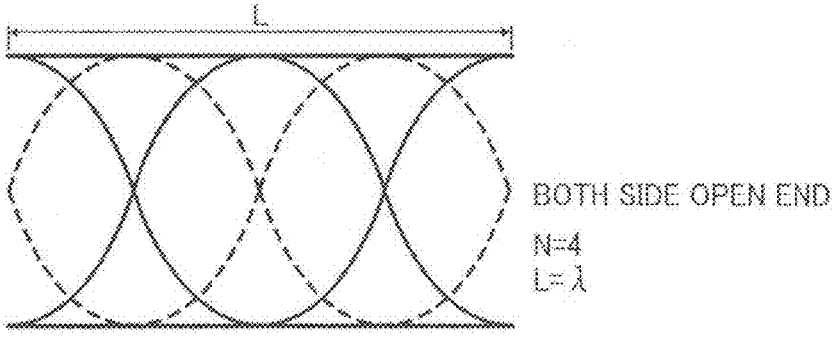
Figure 5C:
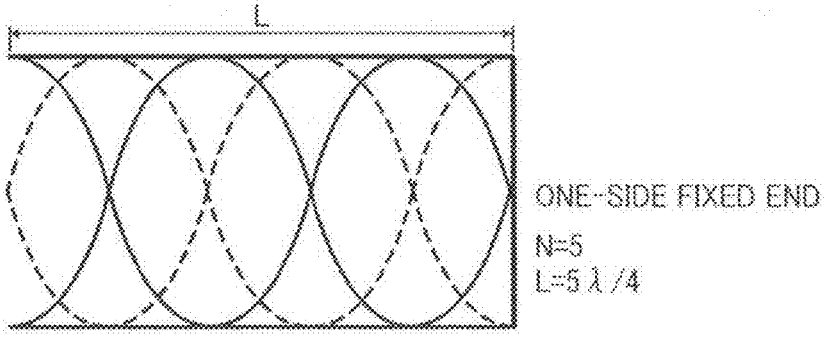

FIGS. 5A to 5C are explanatory views each for explaining a standing wave of a velocity distribution and a pressure distribution generated in the liquid in the liquid-column resonant chamber when N is 4 and 5.

FIG. 5A shows both ends of the liquid-column resonant liquid chamber 18 in a longitudinal direction are closed when N=4. FIG. 5B shows both ends of the liquid-column resonant liquid chamber 18 in a longitudinal direction are opened when N=4. FIG. 5C shows one of both ends of the liquid-column resonant liquid chamber 18 in a longitudinal direction is opened and the other is closed when N=5.

In FIGS. 4A to 4D and 5A to 5C, a solid line is a velocity standing wave and a dashed line is a pressure standing wave. The wave generated in the liquid in the liquid-column resonant liquid chamber 18 is actually a longitudinal wave, but is described as a sine (cosine) wave in FIGS. 4A to 4D and 5A to 5C. As FIG. 4A shows, it is instinctively understandable that the velocity distribution has amplitude of zero at the closed side wall and has maximum amplitude at the opened side wall, and is described as a sine wave. The standing wave pattern differs according to whether both side walls in a longitudinal direction are opened or closed (combination pattern of an opening end and a fixed end), and combination patterns of the opening end and the fixed end are described together in FIGS. 4A to 4D and 5A to 5C.

As mentioned later, conditions of the end depends on openings of the projection holes 19 or a communication pathway communicating the liquid-column resonant liquid chamber 18 with the liquid common feed pathway 17. In acoustics, at an open end, a medium (liquid) has a maximum travel velocity in a longitudinal direction, but has a pressure of zero. At a fixed (closed) end, the medium has a travel velocity of zero and has a maximum pressure. The fixed (closed) end is acoustically thought a hard wall and a wave completely reflects. When the end is completely open or closed ideally, it is thought waves are overlapped to form standing waves in FIGS. 4A to 4D and 5A to 5C. The number and location of the projection holes 19 vary the standing wave patterns, and a resonant frequency appears at a position different from a position determined by the formula (3), but the drive frequency is properly adjusted to determine stable projection conditions.

When the liquid has a sound velocity of 1,200 m/s, the liquid-column resonant liquid chamber 18 has a length L of 1.85 mm, and walls exist at both ends and a N=2 resonance mode equivalent to both-side fixed ends, the most efficient resonant frequency is determined to be 324 kHz from the formula (2). When the liquid has a sound velocity of 1,200 m/s, the liquid-column resonant liquid chamber has a length L of 1.85 mm, and walls exist at both ends and a N=4 resonance mode equivalent to both-side fixed ends, the most efficient resonant frequency is determined to be 648 kHz from the formula (2). Even with the same liquid-column resonant liquid chamber, higher level resonance can be used.

The liquid-column resonant liquid chamber 18 is equivalent to both closed ends. In consequence of an opening of the projection hole 19, the end is preferably like a soft wall acoustically to increase frequency, but may be open. The consequence of an opening of the projection hole means that acoustic impedance decreases, and particularly a compliance component increases. The projection holes 19 formed in the liquid-column resonant liquid chambers 18 are wholly located at one side (opposite to the liquid common feed pathway 17 in a longitudinal direction as FIG. 1 shows, the one side can be regarded as an open end. Therefore, the liquid-column resonant liquid chambers 18 forming walls at both ends in a longitudinal direction in FIGS. 4B and 5A are preferably used because of being capable of using all resonance modes, i.e., both-side fixed ends and one-side open end.

The number of the projection hole 19, locations and cross-sectional shapes thereof are elements of deciding the drive frequency, and the drive frequency is properly determined. The closer to one side in a longitudinal direction the location of the projection hole 19, the looser the restraint of the wall of the liquid-column resonant liquid chambers 18. Therefore, the closer to one side in a longitudinal direction the location of the projection hole 19, the end in a longitudinal direction is almost an open end and the drive frequency is changed higher. When the number of the projection holes is increased, the restraint of the wall of the liquid-column resonant liquid chambers 18 becomes loose at an end where the projection holes 19 are located in a longitudinal direction, and the end in a longitudinal direction is almost an open end and the drive frequency is changed higher. Besides, when the cross-sectional shape or the size of the projection hole 19 is changed, the drive frequency needs changing.

When a voltage is applied to the oscillator 20 with the thus determined drive frequency, a piezoelectric body 20A of the oscillator 20 is deformed according to the voltage variation, and an elastic plate 20B is displaced. Consequently, an oscillation correspondent to the drive frequency is added to a liquid in the liquid-column resonant liquid chamber 18 to generate a liquid-column resonant standing wave therein. A liquid-column resonant standing wave generates with a frequency close to the drive frequency a resonant standing wave most efficiently generates with. Specifically, when the liquid-column resonant liquid chamber has a length L between both walls in a longitudinal direction and a distance Le between a wall at the liquid common feed pathway 17 in a longitudinal direction and the projection hole closest to he liquid common feed pathway 17, the drive frequency f generating a liquid-column resonant standing wave is determined by the following formulae (4) and (5). A drive waveform including the drive frequency f determined by the following formulae (4) and (5) as a main component is used to oscillate the oscillator 20 to induce a liquid-column resonance to project a droplet from the projection hole 19. Further, Le/L is preferably larger than 0.6.

$$N\times c/(4L)\leq f\leq N\times c/(4Le) \quad (4)$$

$$N\times c/(4L)\leq f\leq (N+1)\times c/(4Le) \quad (5)$$

The above-mentioned principle of the liquid-column resonance phenomenon is used to from a liquid-column resonant pressure standing wave in the liquid-column resonant liquid chamber 18 in FIG. 1, droplets are continuously projected from the projection hole 19 located on a part of the liquid-column resonant liquid chamber 18. When the projection hole 19 is located at a position where the standing wave most varies in pressure, the projection efficiency increases and the projection can be made at low voltage.

The liquid-column resonant liquid chamber 18 may include one projection hole 19, and preferably includes plural, specifically 2 to 200 projection holes 19 in terms of productivity. When greater than 100, a voltage applied to the oscillator 20 needs to be high to project a desired droplet from more than 100 projection holes and the piezoelectric body 20A of the oscillator 20 unstably behaves.

When plural projection holes 19 are formed for one liquid-column resonant liquid chamber 18, a pitch among the holes preferably from 20 μm to a length of the liquid-column resonant liquid chamber. When less than 20 μm, it is highly possible that droplets projected from the holes adjacent to each other are combined to be a large droplet, resulting in deterioration of particle diameter distribution of a toner.

Next, the liquid-column resonant phenomenon generated in the liquid-column resonant liquid chamber 18 in the droplet projection part 11 is explained.

FIGS. 6A to 6D are schematic views illustrating the liquid-column resonant phenomena in the liquid-column resonant chamber 18.

In FIGS. 6A to 7D, a solid line in the liquid-column resonant liquid chamber 18 represents a velocity distribution at random positions therein in a longitudinal direction, and a direction from the left closed side wall to the right opened side wall is + and the reverse direction is −. A dashed line in the liquid-column resonant liquid chamber 18 represents a pressure distribution at random positions therein in a longitudinal direction, and a positive pressure relative to the atmospheric pressure is + and a negative pressure thereto is −.

As FIG. 1 shows, a height h1 (=about 80 μm) from the bottom of the liquid-column resonant liquid chamber 18 in the droplet projection part 11 to a lower end of the communication pathway communicated with the common feed pathway 17 is not less than two times as high as a height h2 (=about 40 μm) of an opening of the common feed pathway 17. Therefore, the velocity and pressure distributions therein show their temporary variation under approximate conditions that the liquid-column resonant liquid chamber 18 has nearly fixed ends at both sides.

Figure 6A:
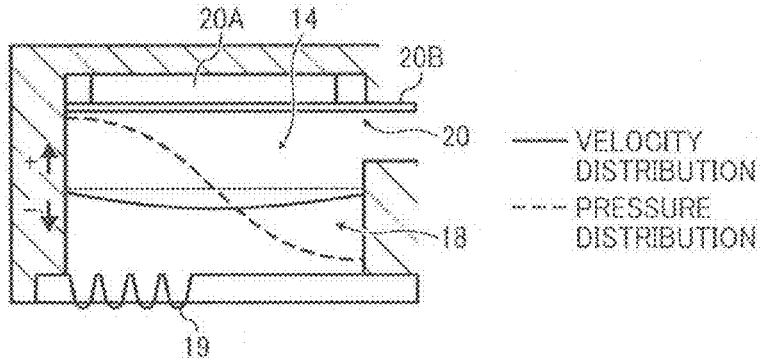
FIGS. 6A to 6D are schematic views illustrating the liquid-column resonant phenomena in the liquid-column resonant chamber.
Figure 6B:
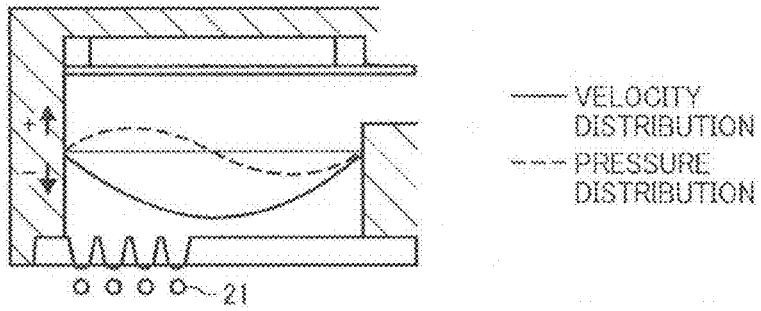

FIG. 6A shows a pressure and velocity waveforms in the liquid-column resonant liquid chamber 18 when discharging a droplet. Then, the liquid in the liquid-column resonant liquid chamber 18 at the closed side wall (near the projection hole 19) has a maximum pressure. This increases a meniscus pressure and the liquid closes to the projection hole. Then, as 6B show, the positive pressure of the liquid near the projection hole 19 decreases and transfers to the negative pressure to project a droplet 21.

Figure 6C:
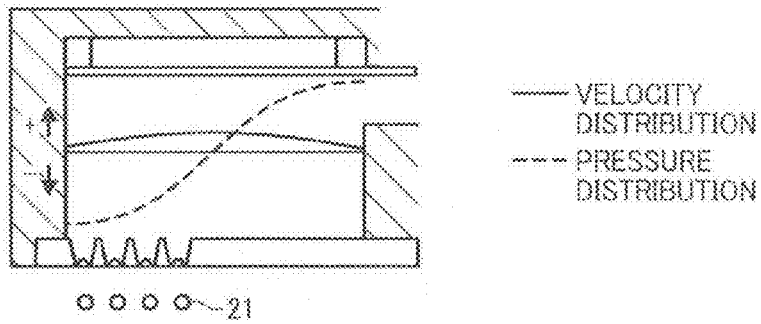
Figure 6D:
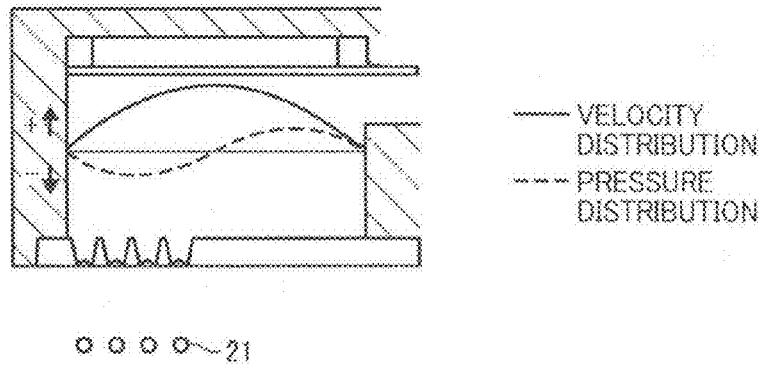

Then, as FIG. 6C shows, a pressure near the projection hole 19 becomes minimum. Since then, filling the toner component liquid 14 in the liquid-column resonant liquid chamber 18 begins. Then, as FIG. 6D shows, the negative pressure near the projection hole 19 decreases and transfers to the positive pressure. At this point, filling the toner component liquid 14 is finished. Then again, as FIG. 5A shows, the positive pressure near the projection hole 19 in the liquid-column resonant liquid chamber 18 becomes maximum.

Thus, in the liquid near the projection hole 19 in the liquid-column resonant liquid chamber 18, the oscillator 20 is driven to form a high frequency to generate a standing wave by liquid-column resonance. Further, since the projection hole 19 is located at a droplet projection area corresponding to an abdominal area of the standing wave by the liquid-column resonance, where the pressure varies most, the droplet 21 is continuosly projected from the projection hole 19 according to a cycle of the abdominal area.

Next, a process since the liquid is initially introduced to the projection hole 19 of the droplet projection part 11 in the liquid-column resonant droplet forming unit 10 until the liquid is projected is explained.

Conventionally, after the liquid-column resonant liquid chamber 18 in the droplet projection part 11 is filled with the toner component liquid 14 and the projection hole 19 is initially filled therewith, a project starting signal is entered to start discharging. However, it is very difficult to have droplets properly project from all the projection holes a time right after discharging starts. It is though t this is due to the following reason.

Typically, an evaporable solvent is used as a solvent for the toner component liquid 14 such that a droplet thereof is easily dried and solidified in a droplet solidifying process mentioned later. However, when the projection hole 19 is filled with the toner component liquid 14 including the evaporable solvent, the solvent evaporates at the meniscus formed in the projection hole 19 and the toner component liquid 14 increases in viscosity. Particularly when a time since the projection hole 19 is initially filled with the toner component liquid 14 until the liquid is projected is long, the toner component liquid 14 in the projection hole 19 is possibly dried and solidified to block the projection hole 19. When the projection hole 19 is blocked, a droplet is not projected therefrom even when a projectsignal is entered.

When the toner component liquid 14 increases in viscosity at the meniscus in the projection hole 19, the liquid is unstably projected and likely to exude therefrom. The toner component liquid 14 exuding therefrom expands over circumferential projection holes 19 and even deteriorates projectability thereof properly discharging droplets.

When plural projection holes 19 formed in the liquid-column resonant liquid chamber 18 are partially blocked, frequency properties in the liquid-column resonant liquid chamber 18 changes. As a result, the other projection holes capable of discharging droplets are likely to unstably projectedroplets.

Conventionally, the liquid in the projection hole 19 increases in viscosity when starting discharging, it is possible that the projection hole 19 does not properly project a droplet when starting discharging or later although properly discharging a droplet at the beginning. Therefore, conventionally, the droplet projection part 11 is difficult to continue to stably project for long periods, which is shown in Comparative Example.

Figure 7:
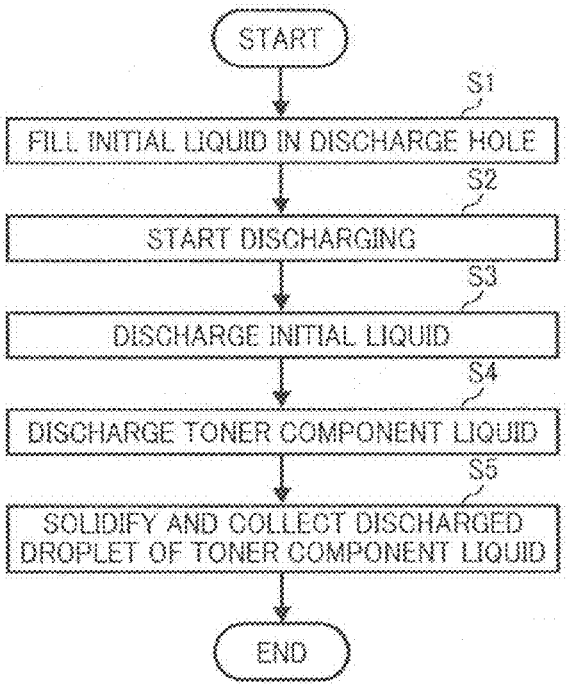
FIG. 7 is a flowchart showing a process of preparing a toner in the present invention.

FIG. 7 is a flowchart showing a process of preparing a toner in the present invention.

In the present invention, as a liquid initially filled in the projection hole 19 of the droplet projection part 11, an initial liquid having a concentration of the toner component lower than that of the toner component liquid 14 or of zero is used (S1). When a liquid having a concentration of the toner component of zero, i.e., a liquid formed of only a solvent after a toner component is removed from the toner component liquid 14 is used as the initial liquid, the (initial) liquid in the projection hole 19 does not vary in viscosity even when vapored (dried) or increases in viscosity slower than the toner component liquid 14. Therefore, the liquid covering an exit of the projection hole 19 has lower viscosity than when the projection hole 19 is initially filled with the toner component liquid 14, and the liquid is difficult to dry and solidify to block the projection hole 19. This is the same when a liquid having a concentration of the toner component lower than the toner component liquid 14 is used as the initial liquid.

The initial liquid initially filled (S1) decreases viscosity of the liquid covering the exit of the projection hole 19 when discharging is started, and the liquid covering the exit of the projection hole 19 properly behaves according to oscillation correspondent to a drive frequency. Since discharging is started (S2), droplets are properly projected from each of the projection holes 19 and are stably projected therefrom since then. As a result, after starting discharging, even when the toner component liquid 14 having a high concentration of the toner component is projected (S4) after the initial liquid (S3), the toner component liquid 14 stably continues to project.

The toner component liquid 14 has a viscosity of about 2 mPa·s and a solvent included therein has a viscosity of about 0.4 mPa·s at room temperature. In the present invention, when the liquid formed of only a solvent is used as the initial liquid, all the projection holes 19 continue to stably project for 1 hr with good reproducibility. Even when the liquid having a concentration of the toner component lower than the toner component liquid 14 is used as the initial liquid, they continue to stably project with good reproducibility.

As a method of introducing the initial liquid to the projection hole 19, various methods can be thought and are not particularly limited, and the following methods can be used.

Figure 8A:
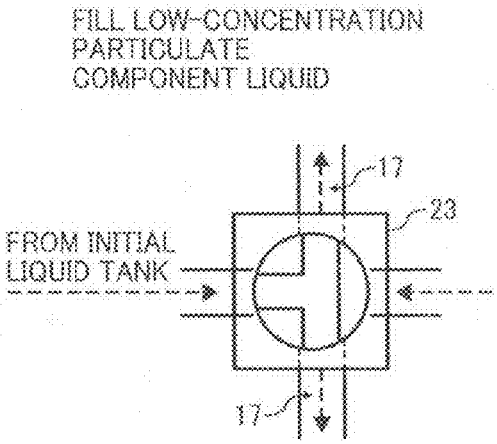
FIGS. 8A and 8B are explanatory views for explaining a three-way stop cock usable for introducing an initial liquid to a projection hole of the liquid-column resonant chamber from a replenishing part receiving replenishment of a toner component liquid.
Figure 8B:
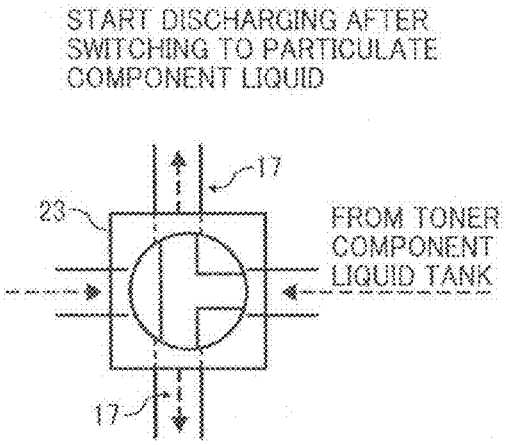

A first method is placing the initial liquid from a filling part receiving the toner component liquid 14 of the droplet projection part 11 to fill the liquid-column resonant liquid chamber 18 with the initial liquid and introduce the liquid to the projection hole 19 thereof. This method can be realized with ease by using the three-way stop cock 23 in FIG. 8. Specifically, the three-way stop cock 23 is located in the liquid common feed pathway 17 of the liquid-column resonant droplet forming unit 10. At the initial introduction, an entrance of the three-way stop cock 23 is connected to an initial liquid feed flow path communicating with an initial liquid tank reserving the initial liquid to introduce the initial liquid from the liquid common feed pathway 17 to the liquid-column resonant liquid chamber 18. Then, the entrance of the three-way stop cock 23 is switched to connect to a toner component liquid feed flow path communicating with a toner component liquid tank reserving the toner component liquid 14 to start discharging the liquid. As the initial liquid introduced is projected, the toner component liquid is gradually filled in the liquid-column resonant liquid chamber 18 from the liquid common feed pathway 17 and the toner component liquid 14 is projected following the initial liquid. In this method, care should be taken when switching the entrance of the three-way stop cock 23 so as not to take in air.

A second method is initially introducing the initial liquid from an exit of the projection hole 19 of the droplet projection part 11. This method includes filling the liquid-column resonant liquid chamber 18 in the droplet projection part 11 with the toner component liquid 14, reducing a pressure in the liquid-column resonant liquid chamber 18 while dipping the projection hole 19 of the droplet projection part 11 in the initial liquid to suction the initial liquid from the exit of the projection hole 19. In this method, care should be taken when suctioning such that the projection hole 19 taken in air. Therefore, the pressure in the liquid-column resonant liquid chamber 18 is preferably increased for only a moment just before starting suctioning.

A third method is filling the liquid-column resonant liquid chamber 18 in the droplet projection part 11 with the toner component liquid 14, dipping the projection hole 19 of the droplet projection part 11 in the initial liquid and reducing a concentration of the toner component in the toner component liquid 14 covering the exit of the projection hole 19. This method is called dipping. The toner component liquid 14 in the projection hole 19 of the droplet projection part 11 contacts the initial liquid has a lower concentration of the toner component due to diffusion phenomenon.

However, dipping dependent only on diffusion phenomenon takes time to sufficiently reduce the concentration of the toner component in the toner component liquid 14 covering the exit of the projection hole 19. Methods of shortening the time include oscillating the initial liquid or the toner component liquid 14 in the projection hole to quicken mixture of the both liquids.

In all of the above-mentioned methods, care should be taken such that an air bubble and other impurities do not enter. Otherwise, projectstability is deteriorated.

In the present invention, it is ideal that the initial liquid introduced to the projection hole 19 has a concentration of the toner component of zero. However, according to the initial introduction methods as the above-mentioned dipping method, the liquid covering the exit of the projection hole 19 inevitably includes a toner component in some cases. The lower the concentration of the toner component in the initial liquid, the more the projectstability improves. Specifically, the initial liquid having a concentration of the toner component not greater than 50% is acceptable, and preferably has a concentration of the toner component not greater than 30%.

The shorter a time from the initial introduction to start of discharging, the better. This is because the diffusion phenomenon or evaporation of the solvent tends to increase the concentration of the toner component in the initial liquid initially introduced to the projection hole 19 until discharging starts.

In the present invention, as mentioned above, after a droplet of the toner component liquid 14 projected from the projection hole 19 in the air is solidified, the solidified droplet is collected (S5).

Methods of solidifying the projected droplet depend on properties of the toner component liquid 14, but may be any methods if the toner component liquid 14 can be solidified. When the toner component liquid 14 includes an evaporable solvent and a toner component dissolved or dispersed therein, a projected droplet of the toner component liquid 14 is dried and the solvent is evaporated in a feed airflow. The solvent is dried by properly selecting a temperature, a steam pressure, etc. of a gas in which the droplet is projected. Even when the solvent is not completely dried, the collected particulate may be further dried in another process after collected if the particulate maintains solidity. Besides, methods of solidifying the droplet by changing temperature or chemical reaction may be used.

The solidified particulate is collected from the gas by a known powder collector such as cyclone collectors and back filters. However, in the present invention, during a specific period from start of discharging, the initial liquid having a concentration of the toner component lower than that of the toner component liquid 14 or of zero is projected, and therefore it is preferable to avoid collecting the particulate during the period. This is because the particulate projected during the period has a smaller particle diameter smaller than a desired and a particle diameter distribution possibly expands if collected.

Figure 9:
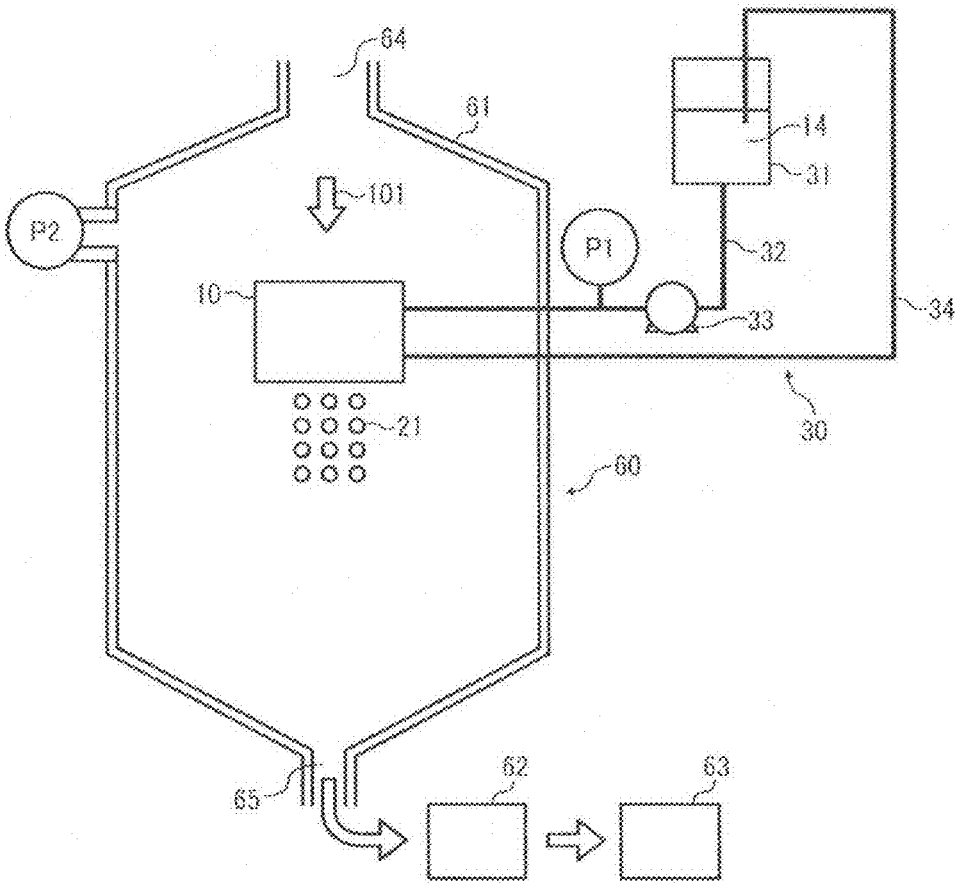
FIG. 9 is a schematic view illustrating an embodiment of a toner preparation apparatus in the present invention.

FIG. 9 is a schematic view illustrating an embodiment of a toner preparation apparatus in the present invention.

The toner preparation apparatus is mainly formed of the liquid-column resonant droplet forming unit 10, a dry collection unit 60 and a toner component liquid filling unit 30.

The toner component liquid filling unit 30 includes a toner component liquid tank 31 reserving the toner component liquid 14. The toner component liquid tank 31 is connected with the liquid-column resonant droplet forming unit 10 through a toner component liquid feed flow path 32. A liquid circulation pump 33 pumping the toner component liquid 14 in the toner component liquid feed flow path 32 is connected therewith. The liquid circulation pump 33 drives to feed the toner component liquid 14 in the toner component liquid tank 31 to the liquid-column resonant droplet forming unit 10 through the toner component liquid feed flow path 32.

The toner component liquid tank 31 is connected with the liquid-column resonant droplet forming unit 10 through a liquid return pipe 34. The toner component liquid 14 which is not fed in the liquid-column resonant liquid chamber 18 of the liquid-column resonant droplet forming unit 10 out of the toner component liquid 14 fed thereto is returned by the drive of the liquid circulation pump 33 into the toner component liquid tank 31 through the liquid return pipe 34.

In the present invention, the toner component liquid feed flow path 32 includes a pressure gauge P1, and the dry collection unit 60 includes a pressure gauge P2. A pressure to feed the liquid to the liquid-column resonant droplet forming unit 10 and a pressure in the dry collection unit 60 are controlled, based on the measured results of the pressure gauges P1 and P2, respectively. When P1 is greater than P2, the toner component liquid 14 possibly exudes from the projection hole 19. When P1 is smaller than P2, the liquid-column resonant droplet forming unit 10 possibly takes air in and stops discharging. Therefore, P1 and P2 are preferably equal to each other.

The dry collection unit 60 includes a chamber 61 including the liquid-column resonant droplet forming unit 10. In the chamber 61, downdraft (feed airflow) 101 is fed from a feed airflow inlet 64, and the droplet 21 projected from the liquid-column resonant droplet forming unit 10 is fed downward not only by gravity but also by the downdraft 101. The droplet fed downward in the chamber 61 is dried and solidified while fed, projected from an exit for collection 65 and fed to a solidified particulate collector 62 to be collected. The particulate collected thereby is then fed to a drier 63 performing a second drying when necessary.

When the projected droplets contact each other before dried, they are combined to form a large particulate. Hereinafter, this is referred to as "cohesion". In order to prepare a toner having a uniform particle diameter distribution, the projected droplets needs to have a distance from each other. However, the projected droplet has a constant initial velocity, but gradually loses velocity due to air resistance. Therefore, another droplet projected after a droplet losing velocity occasionally catches up therewith, resulting in cohesion. The cohesion constantly occurs and the resultant particle diameter distribution seriously deteriorates when particles subjected to cohesion are collected. In the present invention, the downdraft 101 prevents droplets from losing velocity so as not to contact them with each other.

Figure 10:
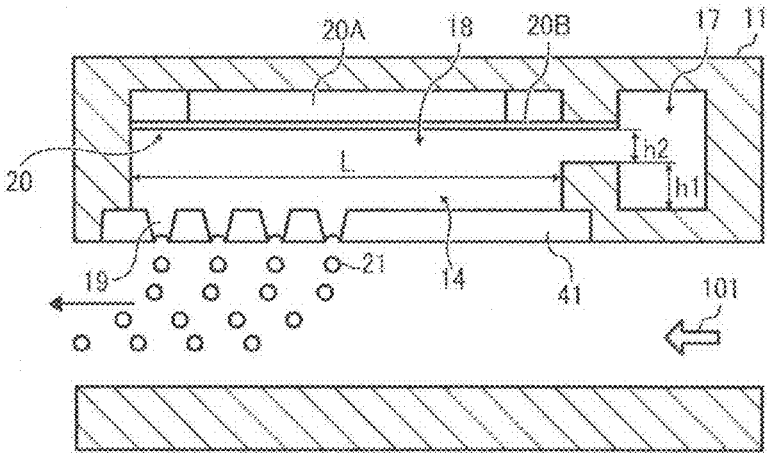
FIG. 10 is a schematic view illustrating an embodiment in which airflow flowing in a horizontal direction relative to the projectedirection of a droplet is used to transfer the droplet.

In FIG. 9, the downdraft 101 runs downward, and as FIG. 10 shows, a feed airflow horizontally running relative to the projectedirection of the droplet may be used as well. However, in this case, the feed airflow is preferably formed such that trajectories of the droplets projected from the projection holes 19 are not overlapped. The feed airflow may obliquely run, not only horizontally relative to the projectedirection of the droplet, and preferably has an angle such that the projected droplets separate from each other.

In the present invention, the downdraft 101 prevents cohesion and feeds the solidified particulate to the solidified particulate collector 62. A first airflow for preventing cohesion and a second airflow for feeding the solidified particulate to the solidified particulate collector 62 may separately be formed. In this case, the first airflow preferably has a flow velocity equal to or not less than a running velocity of the droplet when projected. When slower than the droplet when projected, the first airflow possibly does not fully prevent the droplets from contacting with each other. The first airflow may have other additional properties to prevent the droplets from contacting with each other when necessary, and does not necessarily need the same properties as those of the second airflow. For example, the first airflow may include a chemical material accelerating solidification of the droplet or may be subjected to a physical action to accelerate solidification thereof.

In the present invention, the downdraft 101 may be a laminar flow, a swirl flow or a turbulent flow. Gases for the downdraft 101 are not particularly limited, and air or incombustible gases such as nitrogen may be used. The downdraft 101 has a temperature adjustable when necessary and preferably does not vary therein. A means of varying the airflow status of the downdraft 101 may be located in the chamber 61. The downdraft 101 may be used to prevent the droplet from adhering to the inner surface of the chamber 61 besides preventing them from contacting with each other.

As FIG. 9 shows, when a toner collected by the solidified particulate collector 62 includes much residual solvent, the drier 63 secondly dries the toner to decrease the residual solvent when necessary. Typically known driers such as fluidized-bed driers and vacuum driers can be used for the second drying. The residual organic solvent in a toner not only varies toner properties such as thermostable storageability, fixability and chargeability as time passes, the organic solvent evaporates when a toner image is fixed upon application of heat and possibly has adverse influences on various devices in an image forming apparatus. Therefore, it is desired that the toner is fully dried.

A toner for use in the present invention is explained.

The toner includes at least a binder resin, a colorant and a wax, and other components such as a charge controlling agent and additives when necessary.

The toner component liquid for use in the present invention is explained.

The toner component liquid is a liquid including a solvent and the toner component dissolved or dispersed therein. The toner component liquid may not include a solvent, and a part or the entire toner component is dissolved and mixed therein. Same known toner materials can be used if the toner component liquid can be prepared. The toner component liquid is projected from the liquid-column resonant droplet forming unit 10 to become a microscopic droplet, which is dried and solidified, and collected by the solidified particulate collector 62 to prepare a toner.

Specific examples of the binder resin include, but are not limited to, conventionally-used resins such as a vinyl polymers including styrene monomers, acrylic monomers or methacrylic monomers, or copolymers including two or more of the monomers; polyester polymers; polyol resins; phenol resins; silicone resins; polyurethane resins; polyamide resins; furan resins; epoxy resins; xylene resins; terpene resins; coumarone-indene resins; polycarbonate resins; petroleum resins; etc.

The binder resin is preferably dissolved in a solvent and preferably has known performances.

The binder resin preferably includes elements soluble with tetrahydrofuran (THF), having at least one peak in a range of 3,000 to 50,000 (number-average molecular weight) in a molecular weight distribution by GPC thereof in terms of the fixability and offset resistance of the resultant toner. In addition, the THF-soluble elements having a molecular weight not greater than 100,000 is preferably from 60 to 100% by weight based on total weight of the THF-soluble elements.

Further, the THF-soluble elements preferably have a main peak in a molecular weight range of from 5,000 to 20,000. The binder resin preferably includes a resin having an acid value of from 0.1 to 50 mg KOH/g in an amount not less than 60% by weight.

The acid value of the binder resin is measured according to JIS K-0070.

Specific examples of magnetic materials for use in the present invention include (1) magnetic iron oxides such as magnetite, maghematite and ferrite and iron oxides including other metal oxides; (2) metals such as iron, cobalt and nickel or their metal alloys with metals such as aluminum, cobalt, copper, lead, magnesium, tin, zinc, antimony, beryllium, bismuth, cadmium, calcium, manganese, selenium, titanium, tungsten and vanadium; and (3) their mixtures. The magnetic material can be used as a colorant. The toner preferably includes the magnetic material in an amount of from 10 to 200 parts by weight, and more preferably from 20 to 150 parts by weight per 100 parts by weight of the binder resin. The magnetic material preferably has a number-average particle diameter of from 0.1 to 2 μm, and more preferably from 0.1 to 0.5 μm. The number-average particle diameter can be determined by measuring a photograph thereof, zoomed by a transmission electron microscope, with a digitizer, etc.

The colorants are not particularly limited, and known colorants can be used.

The toner preferably includes the colorant in an amount of from 1 to 15% by weight, and more preferably from 3 to 10% by weight. The colorant for use in the present invention can be used as a masterbatch when combined with a resin. The masterbatch is used for previously dispersing a pigment and may not be used if the pigment is not fully dispersed. A pigment is finely dispersed in a resin by applying a high shearing strength to the pigment and the resin to prepare a masterbatch. Known resins can be used as the resin used in the masterbatch or used with the masterbatch include known resins. These resins are used alone or in combination.

The masterbatch is preferably used in an amount of from 0.1 to 20 parts by weight per 100 parts by weight of the binder resin. A dispersant may be used to increase dispersibility of the pigment when preparing the masterbatch. The dispersant preferably has high compatibility with a binder resin in terms of pigment dispersibility. Specific examples of marketed products thereof include AJISPER PB821 and AJISPER PB822 from Ajinomoto Fine-Techno Co., Inc.; Disperbyk-2001 from BYK-Chemie GmbH; and EFKA-4010 from EFKA Additives B.V.

A toner preferably includes the dispersant in an amount of from 0.1 to 10% by weight based on total weight of the colorant. When less than 0.1% by weight, the pigment is insufficiently dispersed occasionally. When greater than 10% by weight, the chargeability of the resultant toner occasionally deteriorates due to high humidity. The dispersant is preferably used in an amount of from 1 to 200 parts by weight, and more preferably from 5 to 80 parts by weight per 100 parts by weight of the colorant. When less than 1 part by weight, dispersibility is insufficient. When greater than 200 parts by weight, the resultant toner occasionally deteriorates in chargeability.

The toner of the present invention may include a wax besides a binder resin and a colorant. Any known waxes can be used, and specific examples thereof include aliphatic hydrocarbon waxes such as low-molecular-weight polyethylene, low-molecular-weight polypropylene, a polyolefin wax, a microcrystalline wax, a paraffin wax and a sasol wax; aliphatic hydrocarbon wax oxides such as polyethylene oxide wax or their block copolymers; plant waxes such as a candelilla wax, a carnauba wax, a Japan wax, and a jojoba wax; animal waxes such as a bees wax, a lanolin and a whale wax; mineral waxes such as an ozokerite, a ceresin and a petrolatum; waxes mainly including fatty ester such as a montanic acid ester wax and a mosquito star wax; and waxes having partially or wholly deacidified fatty ester.

The wax preferably has a melting point of from 70 to 140° C., and more preferably from 70 to 120° C. to balance the fixability and offset resistance of the resultant toner. When lower than 70° C., blocking resistance thereof tends to deteriorate. When higher than 140° C., the offset resistance thereof is occasionally difficult to develop. The toner of the present invention preferably includes the waxes in an amount of from 0.2 to 20 parts by weight, and more preferably from 0.5 to 10 parts by weight per 100 parts by weight of a binder resin. The melting point of the wax is the maximum endothermic peak when measured by a DSC method. The endothermic peak of the wax or toner is preferably measure by a high-precision inner-heat input-compensation differential scanning calorimeter. The measurement method is based on ASTM D3418-82. A DSC curve measured when the temperature is increased at 10° C./min after increasing and decreasing the temperature is used.

As other additives, various metal soaps, fluorine-containing surfactants and dioctylphthalate may optionally be included in the toner of the present invention for the purpose of protecting a photoreceptor or a carrier; improving the cleanability thereof; controlling heat, electrical and physical properties thereof; controlling the resistivity thereof; controlling the softening point thereof; and improving the fixability thereof; etc. As an electroconductivity imparting agent, inorganic fine powders such as tin oxide, zinc oxide, carbon black, antimony oxide, titanium oxide, aluminum oxide and alumina may optionally be included therein. The inorganic fine powders may optionally be hydrophobized. Lubricants such as polytetrafluoroethylene, zinc stearate and polyvinylidenefluoride; abrasives such as cesium oxide, silicon carbonate and strontium titanate; caking inhibitors; and developability improvers such as white and black particulate materials having polarities reverse to that of a toner can also be used in a small amount.

The additives preferably treated with various agents such as silicone varnishes, various modified silicone varnishes, silicone oils, various modified silicone oils, silane coupling agents, silane coupling agents having functional groups and other organic silicon compounds for the purpose of controlling the charge amount of the resultant toner. Inorganic particulate materials can be preferably used as the additives. Specific examples of the inorganic particulate material include known inorganic particulate materials such as silica, alumina and titanium oxide.

Besides, polymer particulate materials, e.g., polystyrene, ester methacrylate and ester acrylate copolymers formed by soap-free emulsifying polymerization, suspension polymerization and dispersion polymerization; polycondensed particulate materials such as silicone, benzoguanamine and nylon; and polymerized particulate materials formed of thermosetting resins can also be used.

The additives can be treated with a surface treatment agent to increase the hydrophobicity to prevent deterioration of fluidity and chargeability even in an environment of high humidity. Specific examples of the surface treatment agent include a silane coupling agent, a sililating agent, a silane coupling agent having an alkyl fluoride group, an organic titanate coupling agent, an aluminum coupling agent silicone oil and a modified silicone oil.

The inorganic particulate material preferably has a primary particle diameter of from 5 nm to 2 μm, and more preferably from 5 to 500 nm. The inorganic particulate material preferably has a specific surface area of from 20 to 500 $m^2/g$ when measured by a BET nitrogen absorption method. The inorganic particulate material is preferably included in a toner in an amount of from 0.01 to 5% by weight, and more preferably from 0.01 to 2.0% by weight based on total weight of the toner.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particulate materials prepared by a soap-free emulsifying polymerization method such as a polymethylmethacrylate particulate material and a polystyrene particulate material. The polymer particulate materials comparatively have a narrow particle diameter distribution and preferably have a volume-average particle diameter of from 0.01 to 1 μm.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

First, carbon black dispersion was prepared.

Seventeen (17) parts of carbon black (Regal 1400 from Cabot Corp.), 3 parts of a pigment dispersant (AJISPER PB821 from Ajinomoto Fine-Techno Co., Inc.) and 80 parts of ethylacetate were primarily dispersed by a mixer having an agitation blade to prepare a primary dispersion. The primary dispersion was more dispersed with higher shearing strength by a beads mill (LMZ type from Ashizawa Finetech Ltd. using zirconia beads having a diameter of 0.3 mm) to prepare a secondary dispersion completely free from aggregates having a size not less than 5 μm.

Next, a wax dispersion was prepared.

(Eighteen) 18 parts of carnauba wax, 2 parts of a wax dispersant and 80 parts of ethylacetate were primarily dispersed by a mixer having an agitation blade to prepare a primary dispersion to prepare a primary dispersion. After the primary dispersion was heated to have a temperature of 80° C. while agitated to dissolve the carnauba wax, the dispersion was cooled to have a room temperature and wax particles having a maximum diameter not greater than 3 μm were precipitated. The primary dispersion was more dispersed with higher shearing strength by a beads mill (LMZ type from Ashizawa Finetech Ltd. using zirconia beads having a diameter of 0.3 mm) such that the wax particles have a maximum diameter not greater than 1 μm.

Next, a toner component liquid having the following formula and including a binder resin, the colorant dispersion and the wax dispersion was prepared. One hundred (100) parts of a polyester resin, each 30 parts of the colorant dispersion and thee wax dispersion, and 840 parts of ethylacetate were agitated for 10 min to be uniformly dispersed by a mixer having an agitation blade to prepare a dispersion. The pigment and wax did not aggregate with the solvent.

Conditions of the toner preparation apparatus are explained.

The liquid-column resonant liquid chamber 18 in the liquid-column resonant droplet forming unit 10 had a length of 1.85 mm between both ends in a longitudinal direction, the resonance mode was N=2, and the first to fourth projection holes 19 line along the longitudinal direction were located at an abdominal area of the N=2 mode pressure standing wave. Function generator WF1973 from NF Corp. was used as a drive signal generator and connected with the oscillator 20 with a polyethylene-coated lead wire. The drive frequency was 330 kHz equivalent to the liquid resonant frequency. Lead zirconate titanate (PZT) was used as the piezoelectric body 20A of the oscillator 20.

The chamber 61 in the dry collection unit 60 was a vertically-fixed cylinder having an inner diameter of 400 mm and a height of 2,000 mm, and had narrowed upper end and lower end. The upper end feed airflow entrance had a diameter of 50 mm and the lower end feed airflow exit had a diameter of 50 mm. The liquid-column resonant droplet forming unit 10 was located at the center in the chamber 61 in a horizontal direction at a height of 300 mm from the upper end of the chamber 61. The downdraft 101 was nitrogen running at 10.0 m/s and having a temperature of 40° C. A cyclone collector was used as the solidified particulate collector 62.

The toner component liquid was projected by the toner preparation apparatus, dried and solidified in the chamber 61 to prepare toner particles, and the toner particles were collected by the cyclone collector. The number of the projection holes 19 used for discharging was 192. A projectstart signal was given to each of the 48 liquid-column resonant liquid chambers 18 each having four projection holes 19 to perform discharging. A drive signal given to the oscillator 20 was a sine wave signal having a frequency of 340 kHz. The piezoelectric body 20A of the oscillator 20 was applied with a peak-to-peak voltage of 10 V. The toner component liquid 14 had a concentration of 10% (by weight). The initial liquid was pure ethyl acetate which does not include the toner component.

An image of a droplet when projected is imaged by a CCD camera to count the number of channels (one channel=one liquid-column resonant liquid chamber 18) discharging, based on the imaged image. The images were imaged within one second after discharging started, and 5 min, 10 min, 20 min, 30 min and 60 min after discharging started. Discharging status after 60 mm passed was not evaluated because 60 min is far over a desired stable discharging time and takes time to evaluate. Therefore, 60 min is determined as a maximum time of stable projection.

The above-mentioned dipping was performed to introduce the initial liquid to the projection hole 19. In dipping, a drive signal having a frequency of 340 kHz was given to drive the oscillator 20 to oscillate the liquid in the liquid-column resonant liquid chamber 18 while the projection hole 19 is dipped in the initial liquid. This initial liquid introduction method is an initial introduction method A-1. Besides this, the following methods were used.

(A-1) Dipping while oscillating the liquid in the liquid-column resonant liquid chamber 18 with a sine wave drive signal of 340 kHz and 10 V. Dipping time was 3 sec and oscillating time was 2 sec during dipping.

(A-2) Dipping while oscillating the liquid in the liquid-column resonant liquid chamber 18 with a sine wave drive signal of 28 kHz and 20 V. Dipping time was 3 sec and oscillating time was 2 sec during dipping.

(B) Pressurizing the inside of the liquid-column resonant liquid chamber 18 and depressurizing to suction the initial liquid from the projection hole. The projection hole was dipped in the initial liquid for 3 sec, pressurizing time was 0.5 sec during the dipping time and the depressurizing time was 2 sec during the dipping time.

(C) Dipping dependent only on diffusion phenomenon without oscillating. Dipping time was 120 sec.

(D) The initial liquid was not introduced to the projection hole 19, and the toner component liquid was initially introduced thereto (Comparative Example).

(E) The initial liquid was placed from a filling part receiving the toner component liquid 14 of the droplet projection part 11 to fill the liquid-column resonant liquid chamber 18 with the initial liquid in the droplet projection part 11. The three-way stop cock 23 in FIG. 8 was located in the liquid common feed pathway 17 of the liquid-column resonant droplet forming unit 10. At the initial introduction, an entrance of the three-way stop cock 23 was connected to an initial liquid feed flow path communicating with an initial liquid tank reserving the initial liquid to introduce the initial liquid from the liquid common feed pathway 17 to the liquid-column resonant liquid chamber 18. Then, the entrance of the three-way stop cock 23 was switched to connect to a toner component liquid feed flow path communicating with a toner component liquid tank reserving the toner component liquid 14 to start discharging the liquid. As the initial liquid introduced was projected, the toner component liquid was gradually filled in the liquid-column resonant liquid chamber 18 from the liquid common feed pathway 17 and the toner component liquid 14 was projected following the initial liquid.

The results of Examples and Comparative Examples are shown in Table 1.

The solid content concentration (SCC) represents a toner component concentration in the initial liquid (% by weight). The number of channels discharging (NCD) represents the number thereof normally discharging among the channels drive signals are given to.

Figure 11A:
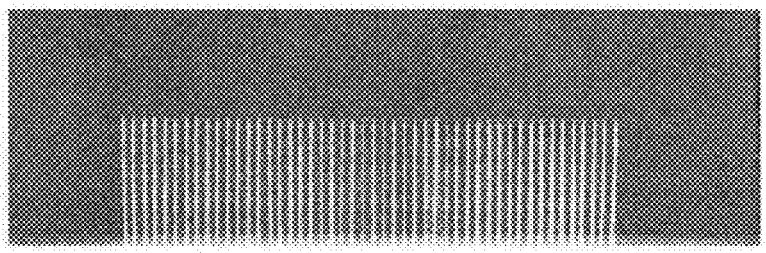
FIGS. 11A and 11B are an image imaging discharging right after starting discharging in Example 1 and an image imaging discharging 60 min after starting discharging therein, respectively.
Figure 11B:
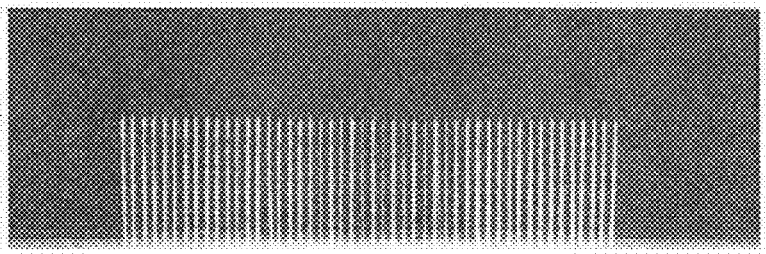

FIGS. 11A and 11B are an image imaging discharging right after starting discharging in Example 1 and an image imaging discharging 60 min after starting discharging therein, respectively.

TABLE 1

| | | | NCD | | | | | |
|---|---|---|---|---|---|---|---|---|
| | Method | SCC [%] | Start | 5 min | 10 min | 20 min | 30 min | 60 min |
| Example 1 | A-1 | 0 | 48 | 48 | 48 | 48 | 48 | 48 |
| Example 2 | A-1 | 10 | 48 | 48 | 48 | 48 | 48 | 47 |
| Example 3 | A-1 | 20 | 48 | 48 | 48 | 48 | 48 | 48 |
| Example 4 | A-1 | 30 | 48 | 48 | 48 | 48 | 48 | 48 |
| Example 5 | A-1 | 40 | 48 | 48 | 47 | 46 | 46 | 44 |
| Example 6 | A-1 | 50 | 48 | 46 | 46 | 45 | 45 | 45 |
| Example 7 | A-2 | 0 | 48 | 48 | 48 | 48 | 48 | 48 |
| Example 8 | A-2 | 50 | 48 | 48 | 48 | 48 | 48 | 48 |
| Example 9 | B | 0 | 48 | 48 | 48 | 48 | 48 | 48 |
| Example 10 | B | 50 | 47 | 47 | 47 | 47 | 47 | 47 |
| Example 11 | C | 0 | 48 | 48 | 48 | 48 | 48 | 48 |
| Example 12 | C | 50 | 48 | 48 | 48 | 48 | 47 | 40 |
| Example 13 | E | 0 | 48 | 48 | 48 | 48 | 48 | 48 |
| Example 14 | E | 50 | 48 | 48 | 48 | 48 | 48 | 48 |
| Comparative Example 1 | D | — | 40 | 13 | 2 | 1 | 0 | — |

Having now fully described the invention, it will be apparent to one of ordinary skill in the art that many changes and modifications can be made thereto without departing from the spirit and scope of the invention as set forth therein.

What is claimed is:

1. A method of producing particulate, comprising:

introducing an initial liquid comprising a particulate component in a lower concentration than that of a liquid comprising a particulate component or no concentration to a projection hole of a droplet projector so as to be projected at the start of the discharging;

discharging a droplet of the liquid comprising a particulate component from the projection hole; and solidifying the droplet to form a particulate.

2. The method of claim 1, wherein the step of introducing the initial liquid further comprises:

introducing the initial liquid to the projection hole from an exit thereof.

3. The method of claim 2, wherein the step of introducing the initial liquid further comprises:

dipping the projection hole filled with the liquid comprising a particulate component in the initial liquid so as to lower the concentration of the initial liquid covering the exit of the projection hole prior to the step of introducing an initial liquid.

4. The method of claim 3, wherein the step of introducing the initial liquid further comprises:

oscillating the initial liquid or the liquid comprising a particulate component while dipping the projection hole filled with the liquid comprising a particulate component in the initial liquid.

5. The method of claim 2, wherein the step of introducing the initial liquid further comprises:

dipping the projection hole in the initial liquid; and suctioning the initial liquid in the projection hole.

6. The method of claim 1, wherein the step of introducing the initial liquid further comprises:

filling the initial liquid in the droplet projector from a filling part thereof receiving the liquid comprising a particulate component.

7. The method of claim 1, wherein the droplet projector comprises a liquid-column resonant liquid chamber, further comprising:

oscillating the liquid comprising a particulate component or the initial liquid in the liquid-column resonant liquid chamber to form a liquid-column resonant standing wave; and discharging the liquid from the projection hole of the liquid-column resonant liquid chamber, formed in an abdominal area of the standing wave.

* * * * *